United States Patent [19]

Grether et al.

[11] Patent Number: 4,563,843

[45] Date of Patent: Jan. 14, 1986

[54] HEAT INSULATION WINDOW

[75] Inventors: Paul Grether, Seuzach; Kurt Brader, Winterthur; Bruno Keller, Zurich, all of Switzerland

[73] Assignee: Sulzer Brothers Limited, Winterthur, Switzerland

[21] Appl. No.: 576,332

[22] Filed: Feb. 2, 1984

[30] Foreign Application Priority Data

Feb. 9, 1983 [CH] Switzerland ..... 715/83

[51] Int. Cl.[4] ..... E06B 7/12

[52] U.S. Cl. ..... 52/172; 52/789; 52/790; 49/DIG. 1

[58] Field of Search ..... 52/172, 788, 789, 790, 52/398, 399, 171; 49/DIG. 1

[56] References Cited

U.S. PATENT DOCUMENTS 2,525,717 10/1950 Ottenheimer ..... 52/399
2,883,718 4/1959 Persson ..... 52/398 X
4,149,348 4/1979 Pyzewski ..... 52/172
4,471,589 9/1984 Schmidlin ..... 52/399

FOREIGN PATENT DOCUMENTS 2130496 2/1972 Fed. Rep. of Germany ..... 52/398
204057 8/1960 Sweden ..... 49/DIG. 1

*Primary Examiner*—Carl D. Friedman
*Attorney, Agent, or Firm*—Kenyon & Kenyon

[57] ABSTRACT

The insulated window construction is characterized in having a substantially uniform heat transition coefficient. The uniformity of the heat transition coefficient is obtained by increasing the distance between the window panes and the heat resistance in the edge region of the window is matched to that in the region of the window area which is undisturbed by the edge. The edge region is formed by a frame which has a pair of separate metallic frame members which are joined together and spaced apart by non-metallic webs so as to define an insulation path of at least 0.8 times the clearance between the panes.

14 Claims, 1 Drawing Figure

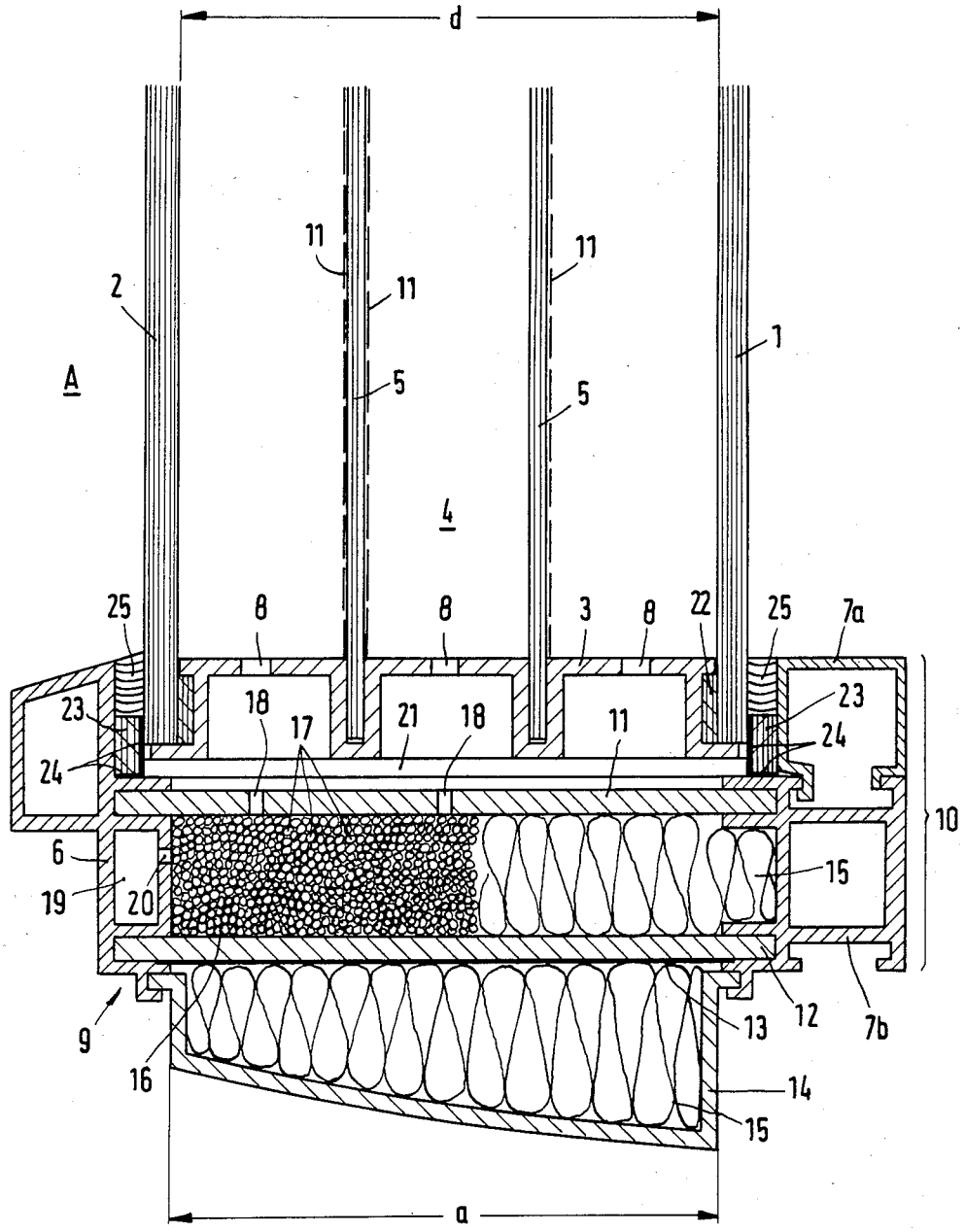
d
11
11
11
2
1
A
5
5
4
25
8
8
3
8
22
25
7a
23
18
17
21
18
11
23
24
24
10
6
19
20
15
9
16
13
12
7b
14
15
a

HEAT INSULATION WINDOW

This invention relates to a heat insulation window.

As is known, various types of windows have been constructed for heat insulation purposes. For example, it has been known to construct a window with two panes of glass within a rigid frame in order to form a dead space between the panes for insulation purposes. In more recent years, it has been known to provide a selectively reflecting coating on the glass surfaces and/or to fill the space between the panes with a gas of low thermal conductivity, for example argon in order to substantially reduce the heat transition coefficient, i.e. the area k-value of the window in the region undisturbed by the edge. While improvements have been made on the glass side, the designs of the glass edge union and of the window frames have been practically unchanged.

It has also been known that a reduction in the area k-value—in its significance the k-value corresponds to the u-value in USA— results in an increase of the temperature difference between the outer and inner panes of an insulation window. Because of the higher temperature gradient, more heat is conducted through the glass edge union and the window frame with the contiguous glass surfaces inside and outside acting as heat exchange surfaces due to the transverse conduction in the glass.

Detailed studies of the whole system of the glass, glass edge union and frame of a heat insulaton window have shown that at improved k-values, the action of the edge zone takes on decisive importance for the heat resistance of the total system because the relatively poor k-value at the edge affects a larger region due to the transverse conduction from the edge into the glass surfaces. As an example, a metallic spacer section which is commonly used in conventional heat insulation windows causes a peripheral cold zone at the inner glass edge of a width of up to eight centimeters, independently of the overall size of the window.

Accordingly, it is an object of this invention to provide an optimal total k-value for the total system of frame, glass edge union and glass surface wherein the same k-value or heat resistance exists through the window.

It is another object of this invention to provide a heat insulation window which has a substantially uniform heat transition coefficient.

It is another object of the invention to provide a heat insulation window which has a substantially uniform thermal resistance over the entire surface of the window.

It is another object of the invention to provide an energy efficient window.

Briefly, the invention is directed to a heat insulation window which is constructed of at least a pair of outer panes, a peripheral spacer for spacing the panes from each other and a frame in which the panes and spacer are mounted.

In accordance with the invention, the outer or cover panes of the window are spaced from each other by a clearance of at least 50 millimeters to define an air space while the spacer is air-permeable and formed of a nonmetallic material. In addition, at least one transparent partition is disposed between the panes in spaced relation while a selectively reflective coating is disposed on at least one surface of the partition(s) and panes.

Further, the frame which mounts the panes, partition and spacer includes a pair of separate lateral metallic frame members and at least one thermally insulating web which joins the frame members together circumferentially in shear resistance relation to form a closed rigid unit. In addition, the frame members are spaced from each other to define an insulation path of at least 0.8 times the clearance between the window panes while the web has a thermal expansion at least approximately equal to that of the frame members.

Still further, a drying chamber including a desiccant is disposed between the air space defined by the outer panes and an exterior of the window.

The window is such that the metallic frame members are spaced apart relative to the space between the window panes so as to impart a substantially uniform heat transition coefficient k to the window.

As is known, the thermal resistance R of a material layer is given by the expression $d/\lambda$ (lambda); d being the layer thickness in the heat flow direction and $\lambda$, the coefficient of thermal conductivity of the material. The relation between the heat transition coefficient k, called "k-value" above, and the thermal resistance is:

$$R=(1/k)-(1/\alpha i)-(1/\alpha a)$$

the inner heat transmission coefficient $\alpha_i$ being taken as 8 $W/m^2K$ and the outer heat transmission coefficient $\alpha_a$ as 23 $W/m^2K$.

Modern heat insulation windows available on the market today, of the closed construction type, i.e. with an inner space between two cover panes which is sealed as well as possible against the outside and filled with a gas of low thermal conductivity, e.g. argon, and where at least one wall or pane surface is provided with a selectively reflecting coating, attain, when the cover panes are 12 to 24 millimeters apart, heat resistances of 0.45 to 0.7 $m^2K/W$, or area k-values of 1.6 to 1.1 $W/m^2K$.

If such heat insulation windows were to have the heat resistance between the edge zone and the "undisturbed" window area matched, the spacers at the edge of the glass panes would have to be made of material with coefficients of thermal conductivity of 0.025 to 0.035 $W/m^2K$. Such values can, at present, be attained only with very light foam materials—e.g. of polystyrene or polyurethane—or with cotton type fillers. These substances, however, lack the necessary properties of a glass edge union in heat insulation windows of the closed type, namely the properties of being water vapor—and gas-proof, having mechanical carrying capacity and being stable to water and normal environmental influences.

As spacers, which as a minimum requirement must be thermally insulating and mechanically supportive, rigid plastic forms or thin walled sections e.g. of polyvinyl chloride, polyurethane or polyethylene, as well as porous mineral substances, as for instance mineral fiber boards, have proved satisfactory at increased fire protection requirements. These materials have, thermal conductivity coefficients $\lambda$, or respectively, thermal conductivity coefficients averaged over their width in sectional shapes with air- or foam-filled interspaces, of at least 0.05 $W/m^2K$. Consequently, windows whose area k-value is equal to or less than 0.8 $W/m^2K$ and whose heat resistances in the glass and edge zone are matched, must have a layer thickness of the spacer in the heat flow direction or a spacing of the cover panes of at least 50 millimeters.

However, before the layer thickness can be enlarged or the spacing between the cover panes can be increased, consideration must be given to the appearance of convection flows in a space between the panes. Further, consideration should be given to the fact that windows with pane spacings greater than about thirty millimeters cannot be made as a closed system. Instead, such windows require that there be some pressure compensation with the surrounding atmosphere. Generally, convection flows can be readily suppressed by the addition of one or more partitions of glass or a spread plastic foil. Further, these partitions can be provided with heat radiation-reflecting coatings of metal such as silver, gold, or copper, or semi-conducting metal oxides such as tin-doped indium oxide. The surfaces of the outer panes which are directed toward the interior of the window may also be provided with such coatings if desired.

If, due to a relatively large spacing between the cover panes, a window must be formed as an open system, the gas filling between the panes is usually air. However, for open systems, care must be taken that as the window "breaths" no dust or other pollutants such as sulphur dioxide, hydrogen sulfide, nitric oxides, ozone, ammonia, hydrogen chloride, and the like pass into the space between the panes and/or, above all, the least possible water vapor. It is known from practice that water vapor penetrates not only into open systems but also diffuses across sealing and packing components. Thus, a drying chamber for a desiccant is disposed between the air space between the window panes and the exterior of the window. For similar reasons, the spacer must be made permeable to air and water vapor.

The desiccant which may also constitute a dust and pollutant filter may consist, for example of silica gel and/or molecular sieves (zeolites) possibly with the addition of active carbon. If there is a coating in the inner space between the covered panes, the coating can be better protected against corrosion if the coating components which are susceptible to corrosion are admixed to the desiccant in finally divided form, for example as colloidal silver or copper which is precipitated from a salt solution.

The frame for the window must be sturdy, weather proof and rigid. In this respect, it is known from experience that the flexing of the cover panes due to wind must be no more than 1/300 of the linear dimension in the direction of the respective load if the danger of breakage of the panes is not to become impermissibly high. Accordingly, the frame includes a pair of separate lateral metallic frame members and at least one thermally insulating web joining the frame members together circumferentially in shear resistent relation to form a closed rigid unit. The durability of the union is insured by the fact that the thermal expansion of the web is at least approximately equal to that of the frame members. The joining of the frame members and web or webs is advantageously performed by gluing, for example, with an epoxy resin adhesive.

If a "heat bridge" between the metal frame members is to be avoided, the insulation path between the frame members must be at least 0.8 times the clearance between the window panes.

The construction of the frame as a closed unit is necessary in order that diffusion of moisture is impeded to the extent possible although the interior between the cover panes forms a system open to the outside atmosphere. For this purpose, the connecting web may also form a vapor barrier. To this end, a metal foil of a thickness of at most 0.1 millimeter is disposed adjacent to the web to form a vapor barrier. In addition, the web may be used to define a mechanical support for the foil.

Load application on the desiccant in the drying chamber can be avoided and useful life increased by employing an antechamber between and in communication with the drying chamber and the window exterior. At least one of the two chambers may also be advantageously integrated structurally into at least one vertical leg of the frame members. The purpose of the antechamber is on the one hand, to minimize the load on the desiccant that occurs during the "breathing" of the window and, on the other hand, to make the diffusion resistance to the continuous vapor diffusion as great as possible. In this regard, it has been found to be favorable if the antechamber defines a buffer volume which is closed off at least in the direction of the external atmosphere by diffusion-inhibiting openings of narrow cross-section. For example, the buffer volume is at least 100 cubic centimeters per square meter of pane or window surface. At the relatively high frequency vibrations of the window due to alternating wind load, the buffer volume serves to keep the losses of pressed-out dry air as low as possible. Further, the diffusion inhibiting openings are of advantage since these openings provide increased resistance during "exhaling".

These and other objects and advantages of the invention will become more apparent in the following detailed description taken in conjunction with the accompanying drawings wherein:

The drawing illustrates a cross-sectional view through a vertical edge region of a window constructed in accordance with the invention.

Referring to the drawing, the heat insulation window is comprised of a pair of outer panes 1, 2, for example of glass or plastic which are spaced apart by a spacer 3 to define an air space 4 therebetween. As indicated, the window panes 1, 2 are spaced from each other by a clearance d of, for example, 60 millimeters. Alternatively, the clearance d may assume any value from 50 to about 200 millimeters. The spacer 3 which is disposed peripherally about the window panes 1, 2 may be made of any suitable non-metallic material, such as rigid PVC; it is air-permeable, for example by holes 8.

The window also has a pair of transparent partitions 5 spaced between the panes 1, 2 to subdivide the air space 4 in order to suppress convection flows. Each partition 5 may consist of a biaxially formed plastic foil of a thickness of from 20 to 100 $\mu$m or of glass or plastic plates. The surfaces of the partitions 5 are coated on one or both sides with a IR (infra-red)-reflecting coating 11, for example of silver, gold or copper. In like manner, the inside surfaces of the window panes 1, 2 may also be coated with a selectively reflective coating.

As illustrated, elastic bearing pieces 22 are provided between the cover panes 1, 2 and the spacer 3. These bearing pieces 22 consist of commercial foam material and improve the abutment of the panes 1, 2 against the peripheral spacer 3.

The spacer 3 is also provided with holes 8 over the peripheral length so as to communicate with respective compartments defined between the window panes 1, 2 and partitions 5 so as to permit a gas exchange between the air space 4 and an edge region 10 limited from the outside by a closed frame 9.

The frame 9 mounts the window panes 1, 2, partition 5 and spacer 3 therein and includes a pair of separate lateral metallic frame members 6; *7a, 7b* and a pair of thermally insulating webs 11, 12 which join the frame members 6, *7b* together circumferentially in shear resistant relation to form a closed rigid unit. The frame members 6; *7a, 7b* may be made of aluminum or brass and may be joined with the webs 11, 12 by means of an epoxy resin adhesive.

The outer connecting web 12 serves as a vapor barrier and carries a vapor-impermeable metal foil 13, for example of CrNi steel, nickel or titanium. This foil is glued to the web 12 so that the web 12 serves as a mechanical support for the foil 13. Further, the foil is of a thickness of only a few hundredths of a millimeter so that no heat bridge is formed between the frame members 6, *7b*. As viewed, the profiles of the frame members 6, *7b* are so formed that an insulation path a is defined between them which is equal to the clearance d between the window pane 1, 2. Alternatively, the connecting webs 11, 12 may be made of an impermeable material, for example glass, and may be sealed to the frame members 6, *7b* in order to form a vapor-proof connection between the frame members 6, *7b*.

A shaped section 14, for example of PVC serves as a mechanical protection for the metall foil 13. In addition, where the window is a casement window, the shaped section 14 forms a front edge which pivots into a fixed outer frame (not shown) when the window is to be closed. As illustrated, the shaped section 14 is fitted into the frame members 6, *7b*, for example by clamping, and defines a cavity which is filled with a thermally insulating material 15 such as spun glass or plastic foam.

In addition, a drying chamber is defined between the connecting webs 11, 12 and frame members 6, *7b*. As shown, a part of the chamber is filled with insulating material 15 while the remainder of the chamber 16 is filled with desiccant 17. In addition, bores 18 are distributed over a partial height of the drying chamber 16 in the connecting web 11 in order to establish a "flow" connection between the air 4 between the panes 1, 2 and the drying chamber 16. Advantageously, the drying chamber 16 extends at least over a vertical length of the window within a vertical leg of the frame 9.

Further, an air-filled antechamber 19 extends parallel to the drying chamber 16 within the frame member 6 and defines a buffer volume. The antechamber 19 has a bore 20 at one level communicating with the drying chamber 16 and at a second level far removed from the first level, narrow inlet openings (not shown) to the atmosphere. In order to increase diffusion resistance, these inlet openings have diameters of only one to two millimeters. For redundance purposes, that is to avoid the danger of obstruction, two or more inlet openings may be provided.

Of note, the connecting webs 11, 12 are formed of a plastic material of low thermal conductivity, for example polyamide or, in particular, of a glass fiber reinforced polyester. The material is selected so that the coefficient of thermal expansion is adapted as closely as possible to that of the frame members 6, *7b* which are generally made of aluminum or brass.

As shown, the frame member facing the inside of a building is in two parts *7a, 7b*. These parts *7a, 7b* are joined in a detachable manner so that one part *7a* can be removed to permit replacement of one or more panes 1, 2 and/or partitions 5 without the need to destroy the rigid shear resistant unit formed by the members 6, *7b* and the connecting webs 11, 12. Thus, repair of the window in the case of glass breakage can be greatly simplified.

The support of the window frames 1,2 and the spacers 3 carrying the partitions 5 can be effected by way of shims 21 which center these components and which are arranged at points common in the glazer's trade and consist of heat insulating material PVC or hardwood.

A seal is formed between the frame 9 and the window panels 1, 2 via seal elements 23 which consist of at least very largely vapor proof butyl rubber and which are joined with the frame members 6, *7b* and the panes 1, 2 through a permanently plastic glue connection 24, for example of polyisobutyl. As shown, to the outside, the seal elements 23 have a permanently elastic seal 25, for example of polysulfide or silicone based material applied thereon. With the seals 23, 25, the air space 4 is protected to the extent possible against the penetration of water vapor. Accordingly, the life of the desiccant 17 is increased.

In order to change the desiccant, the vertical drying chamber 16 may be formed with a discharge opening at the bottom which is covered by a detachable cover and a similar filling opening which is suitably covered at the top for introducing the desiccant.

The invention thus provides a window which is constructed in a manner so as to have a substantially uniform heat transition coefficient throughout the entire area of the window. For example, the entire window may be constructed to have a heat transition coefficient of, at most, 0.8 $W/m^2K$.

The parts 6, *7b*, 11 and 12 extend over all four sides of the window and are connected by elbows inserted in the corners and fixed by a glue connection in known way. The parts *7a* and 14 are provided on all four sides likewise but are not connected at the corners.

The drying chamber may be disposed in all four sides, but preferably it is on one or both vertical sides only for facilitated exchange of the desiccant.

What is claimed is:

1. A heat insulation window comprising a pair of outer panes defining an air space therebetween and spaced from each other by a clearance of at least 50 millimeters;

a non-metallic air-permeable peripheral spacer spacing said panes from each other;

at least one transparent partition spaced between said panes;

a selectively reflective coating on at least one of said partition and said panes;

a frame mounting said panes, said partition and said spacer therein, said frame including pair of separate lateral metallic frame members and at least one thermally insulating web joining said frame members together circumferentially in shear resistant relation to form a closed rigid unit, said frame members being spaced from each other to define an insulation path of at least 0.8 times said clearance between said panes and said web having a thermal expansion at least approximately equal to said frame members; and a drying chamber for a desiccant disposed between said air space and an exterior of the window.

2. A window as set forth in claim 1 wherein said web forms a vapor barrier.

3. A window as set forth in claim 1 which further comprises a metal foil of a thickness of at most 0.1 millimeter adjacent said web to form a vapor barrier.

4. A window as set forth in claim 3 wherein said web defines a support for said foil.

5. A window as set forth in claim 1 wherein said drying chamber forms a dust and pollutant absorbing filter.

6. A window as set forth in claim 1 which further comprises an antechamber between and in communication with said drying chamber and the window exterior.

7. A window as set forth in claim 6 wherein said antechamber defines a buffer volume and has a plurality of diffusion-inhibiting openings of narrow cross-section communicating said buffer volume with the window exterior.

8. A window as set forth in claim 7 wherein said buffer volume is at least 100 cubic centimeters per square meter of pane surface.

9. A window as set forth in claim 6 wherein one of said frame members has a vertical leg housing at least one of said drying chamber and said antechamber.

10. A heat insulation window comprising a pair of outer panes defining an air space therebetween;

a non-metallic air permeable spacer spacing said panes from each other;

at least one transparent partition spaced between said panes;

a selectively reflective coating on at least one of said panes and partition;

a frame mounting said panes, said partition and said spacer therein, said frame including a pair of separate lateral metallic frame members and at least one thermally insulating web joining said frame member together to form a closed rigid unit, said frame members being spaced apart relative to the spacing between said panes to impart a substantially uniform heat transition coefficient to the window and to define an insulation path therebetween of at least 0.8 times the clearance between said panes; and a drying chamber for a desiccant disposed between said air space and an exterior of the window.

11. A window as set forth in claim 10 wherein said clearance between said panes is at least 50 millimeters.

12. A window as set forth in claim 10 wherein said web has a thermal expansion at least approximately equal to said frame members.

13. A heat insulation window as set forth in claim 10 wherein said clearance is from 50 to 200 millimeters.

14. A heat insulation window as set forth in claim 10 which has a heat transition coefficient of at most 0.8 $W/m^2K$.

* * * * *

UNITED STATES PATENT AND TRADEMARK OFFICE

CERTIFICATE OF CORRECTION

PATENT NO. : 4,563,843

DATED : January 14, 1986

INVENTOR(S) : Paul Grether, et al.

It is certified that error appears in the above-identified patent and that said Letters Patent is hereby corrected as shown below:

Column 3, line 42 change "finally" to -finely-

Column 4, line 54 change "a IR" to -an IR-

Column 5, line 26 change "metall" to -metal-

Column 6, line 8 change "material PVC" to -material, PVC-

Column 8, lines 8 to 9 change "member" to -members-

Signed and Sealed this

*Seventeenth* Day of *June 1986*

[SEAL]

*Attest:*

DONALD J. QUIGG

*Attesting Officer*

*Commissioner of Patents and Trademarks*